US009668540B2

(12) United States Patent
Scofield et al.

(10) Patent No.: US 9,668,540 B2
(45) Date of Patent: Jun. 6, 2017

(54) FOOTWEAR HAVING A FLEX-SPRING SOLE

(71) Applicant: Chinook Asia LLC, Lake Oswego, OR (US)

(72) Inventors: Robert Kent Scofield, Lake Oswego, OR (US); Sangmin Lee, Lake Oswego, OR (US)

(73) Assignee: Chinook Asia LLC, Lake Oswego, OR (US)

( * ) Notice: Subject to any disclaimer, the term of this patent is extended or adjusted under 35 U.S.C. 154(b) by 0 days.

(21) Appl. No.: 14/986,339

(22) Filed: Dec. 31, 2015

(65) Prior Publication Data

US 2016/0183633 A1 Jun. 30, 2016

Related U.S. Application Data

(60) Provisional application No. 62/098,610, filed on Dec. 31, 2014.

(51) Int. Cl.

| | |
|---|---|
| ***A43B 13/20*** | (2006.01) |
| ***A43B 13/18*** | (2006.01) |
| ***A43B 13/12*** | (2006.01) |

(52) U.S. Cl.

CPC ..... *A43B 13/186* (2013.01); *A43B 13/125* (2013.01); *A43B 13/181* (2013.01); *A43B 13/187* (2013.01); *A43B 13/20* (2013.01)

(58) Field of Classification Search

CPC ..... A43B 13/14; A43B 13/18; A43B 13/181; A43B 13/20

USPC ..... 36/27, 28, 29

See application file for complete search history.

(56) References Cited

U.S. PATENT DOCUMENTS

| | | | | |
|---|---|---|---|---|
| 4,255,877 | A | 3/1981 | Bowerman | |
| 4,322,892 | A | 4/1982 | Inohara | |
| 4,624,061 | A | 11/1986 | Wezel et al. | |
| 5,068,981 | A | 12/1991 | Jung | |
| 5,138,776 | A * | 8/1992 | Levin | A43B 13/183 36/27 |
| 5,435,079 | A | 7/1995 | Gallegos | |

(Continued)

OTHER PUBLICATIONS

Feb. 26, 2016, International Search Report of the International Searching Authority from The U.S. Receiving Office, in PCTUS2015068321, which is the international application to this U.S. application.

(Continued)

*Primary Examiner* — Marie Bays

(74) *Attorney, Agent, or Firm* — Kolisch Hartwell, P.C.

(57) ABSTRACT

Footwear and soles for footwear are disclosed. The sole may include an energy transfer base. The energy transfer base may include top and bottom surfaces, and opposed first and second side surfaces. The energy transfer base may include at least one cavity. The at least one cavity may define upper and lower portions of the energy transfer base. The upper portion may be configured to move away from a nominal position and toward the lower portion when a force applied to the upper portion toward the lower portion has a magnitude that is above a predetermined value, and to move back to the nominal position when at least one of (1) the force is no longer applied or (2) the magnitude of the applied force is at or below the predetermined value.

16 Claims, 3 Drawing Sheets

(56) References Cited

U.S. PATENT DOCUMENTS 5,577,334 A * 11/1996 Park ..... A43B 7/14 36/28
5,743,028 A * 4/1998 Lombardino ..... A43B 13/182 36/27
5,761,831 A 6/1998 Cho
D437,675 S 2/2001 Dahlsten
D460,854 S 7/2002 Hung
6,519,873 B1 2/2003 Buttigieg
6,562,427 B2 5/2003 Hung
6,601,042 B1 7/2003 Lyden
6,719,671 B1 4/2004 Böck
6,843,000 B1 * 1/2005 Park ..... A43B 13/181 36/27
7,347,877 B2 3/2008 Clausen et al.
7,788,824 B2 * 9/2010 Hann ..... A43B 13/20 36/102
7,815,688 B2 10/2010 Wilson
7,815,689 B2 10/2010 Bédard et al.
7,846,213 B2 12/2010 Lecomte et al.
7,879,110 B2 2/2011 Phillips
7,998,221 B2 8/2011 Lecomte et al.
8,007,544 B2 8/2011 Jonsson et al.
8,025,699 B2 9/2011 Lecomte et al.
8,196,315 B2 * 6/2012 Ryu ..... A43B 7/08 36/29
8,377,144 B2 2/2013 Jonsson et al.
8,377,146 B2 2/2013 Jonsson et al.
8,387,280 B2 * 3/2013 Grote ..... A43B 7/24 36/27
8,486,156 B2 7/2013 Jónsson
8,495,825 B2 7/2013 Goldston et al.
8,535,390 B1 9/2013 Lecomte et al.
D695,508 S 12/2013 Earle
8,615,900 B2 12/2013 Diekman
8,621,766 B2 1/2014 Goldston et al.
8,640,361 B2 * 2/2014 Testa ..... A43B 13/181 36/27
8,732,983 B2 5/2014 Goldston et al.
8,752,306 B2 6/2014 Goldston et al.
8,858,649 B2 10/2014 Jonsson et al.
8,915,969 B2 12/2014 Boender
8,961,618 B2 2/2015 Lecomte et al.
9,132,022 B2 9/2015 Lecomte et al.
2001/0049888 A1 * 12/2001 Krafsur ..... A43B 7/1425 36/27
2002/0133977 A1 * 9/2002 Pan ..... A43B 21/26 36/28
2003/0051372 A1 * 3/2003 Lyden ..... A43B 1/0081 36/27
2003/0226283 A1 * 12/2003 Braunschweiler ..... A43B 3/24 36/29
2005/0108897 A1 * 5/2005 Aveni ..... A43B 3/0068 36/27
2005/0268488 A1 * 12/2005 Hann ..... A43B 13/20 36/27
2006/0010715 A1 * 1/2006 Tseng ..... A43B 3/0063 36/11.5
2006/0069450 A1 3/2006 McCarvill et al.
2007/0113425 A1 5/2007 Wakley et al.
2007/0175066 A1 * 8/2007 Hann ..... A43B 13/20 36/28
2008/0256827 A1 * 10/2008 Hardy ..... A43B 13/181 36/27
2009/0241372 A1 * 10/2009 Ryu ..... A43B 7/08 36/29
2010/0223810 A1 9/2010 Lekhtman et al.
2010/0263228 A1 * 10/2010 Kang ..... A43B 7/1465 36/29
2010/0281709 A1 * 11/2010 Hwang ..... A43B 3/0063 36/27
2011/0094046 A1 4/2011 Favreau et al.
2011/0113646 A1 * 5/2011 Merritt ..... A43B 13/145 36/28
2011/0113649 A1 * 5/2011 Merritt ..... A43B 13/145 36/102
2011/0138652 A1 * 6/2011 Lucas ..... A43B 13/183 36/28
2011/0154689 A1 * 6/2011 Chung ..... A43B 7/22 36/28
2012/0192461 A1 8/2012 Backus
2012/0246969 A1 * 10/2012 Baum ..... A43B 13/183 36/27
2013/0118028 A1 * 5/2013 Yoon ..... A43B 13/143 36/27
2014/0068966 A1 * 3/2014 Chaffin ..... A43B 13/183 36/28
2014/0230280 A1 * 8/2014 Heard ..... A43B 7/144 36/102
2014/0259461 A1 9/2014 Scofield
2014/0259761 A1 9/2014 Linth
2014/0290098 A1 * 10/2014 Loverin ..... A43B 13/026 36/103
2014/0325873 A1 11/2014 Linth

OTHER PUBLICATIONS

Feb. 26, 2016, Written Opinion of the International Searching Authority from the U.S. Receiving Office, in PCTUS2015068321, which is the international application to this U.S. application.

* cited by examiner

FOOTWEAR HAVING A FLEX-SPRING SOLE

CROSS-REFERENCE TO RELATED APPLICATIONS

This application claims the benefit of U.S. Provisional Patent Application Ser. No. 62/098,610, filed on Dec. 31, 2014 and entitled "Footwear Having A Flex-Spring Midsole." The complete disclosure of the above application is hereby incorporated for reference for all purposes.

INTRODUCTION

Work boots, athletic footwear, and other types of footwear may be designed and constructed from materials that make the footwear highly resistant to wear and tear. For example, the footwear may be designed to include thick outsoles and/or thick midsoles and/or may be constructed from rubber and/or other protective materials to improve the durability of the footwear. However, the above designs and/or materials may lead to heavier footwear and/or footwear that does not transfer energy back into a user's step, which may contribute to fatigue in the user.

SUMMARY

Disclosed herein are examples of apparatuses and systems, which may address the above mentioned problems, among others.

In one example, a sole for footwear is disclosed. The sole may include an energy transfer base. The energy transfer base may include a top surface, a bottom surface, and opposed first and second side surfaces. The energy transfer base may further include at least one cavity. The at least one cavity may include an opening on the first side surface, an opening on the second side surface, and a hollow passage fluidly connecting the openings on the first and second side surfaces. The at least one cavity may define upper and lower portions of the energy transfer base. The upper portion may be configured to move away from a nominal position and toward the lower portion when a force applied to the upper portion toward the lower portion has a magnitude that is above a predetermined value, and to move back to the nominal position when at least one of (1) the force is no longer applied or (2) the magnitude of the applied force is at or below the predetermined value.

In another example, footwear is disclosed. The footwear may include an upper for receiving a foot of a user, and a sole. The sole may include an energy transfer base. The energy transfer base may include a top surface, a bottom surface, and opposed first and second side surfaces. The energy transfer base may further include at least one cavity. The at least one cavity may include an opening on the first side surface, an opening on the second side surface, and a hollow passage fluidly connecting the openings on the first and second side surfaces. The at least one cavity may divide the energy transfer base into upper and lower portions. The upper portion may be configured to move away from an equilibrium position and toward the lower portion when a force applied to the upper portion toward the lower portion has a magnitude that is above a predetermined value, and to move back to the equilibrium position when at least one of (1) the force is no longer applied or (2) the magnitude of the applied force is at or below the predetermined value.

Features, functions, and advantages may be achieved independently in various embodiments of the present disclosure, or may be combined in yet other embodiments, further details of which can be seen with reference to the following description and drawings.

DETAILED DESCRIPTION OF THE DISCLOSURE

Overview

Various embodiments of footwear having flex-spring soles are described below and illustrated in the associated drawings. Unless otherwise specified, an embodiment and/or its various components may contain at least one of the structure, components, functionality, and/or variations described and/or illustrated herein. Furthermore, the structures, components, functionalities, and/or variations described and/or illustrated herein in connection with the present teachings may be included in other embodiments. The following description of various embodiments is merely illustrative in nature and is in no way intended to limit the disclosure, its application, or uses. Additionally, the advantages provided by the embodiments, as described below, are illustrative in nature and not all embodiments provide the same advantages or the same degree of advantages.

Disclosed herein are footwear having flex-spring soles. In some embodiments, the sole may include an energy transfer base having one or more cavities, hollows, or voids. The energy transfer base may include one or more carbon fibers and/or one or more nylons overmolded with rubber and/or thermoplastic polyurethane compound(s).

EXAMPLES, COMPONENTS, AND ALTERNATIVES

The following examples describe selected aspects of exemplary embodiments as well as related systems and/or methods. These examples are intended for illustration and should not be interpreted as limiting the entire scope of the present disclosure. Each example may include one or more distinct inventions, and/or contextual or related information, function, and/or structure.

Example 1

Figure 1:
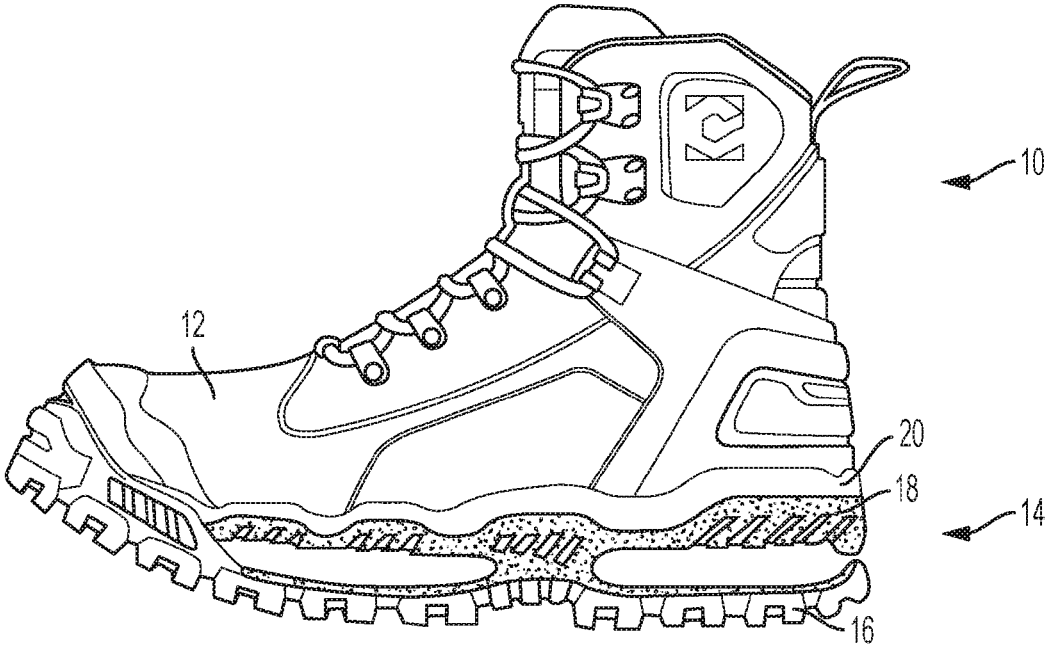
FIG. 1 is a left side view of an example of footwear of the present disclosure having a flex-spring sole.
Figure 2:
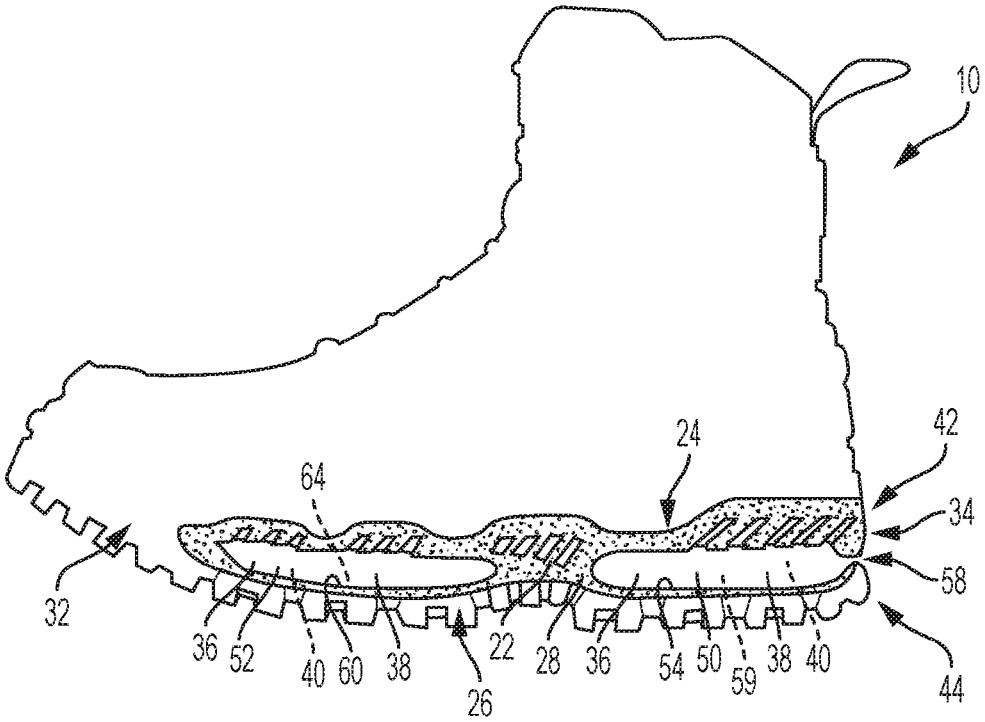
FIG. 2 is a left side view of an example of a midsole for the footwear of FIG. 1.
Figure 3:
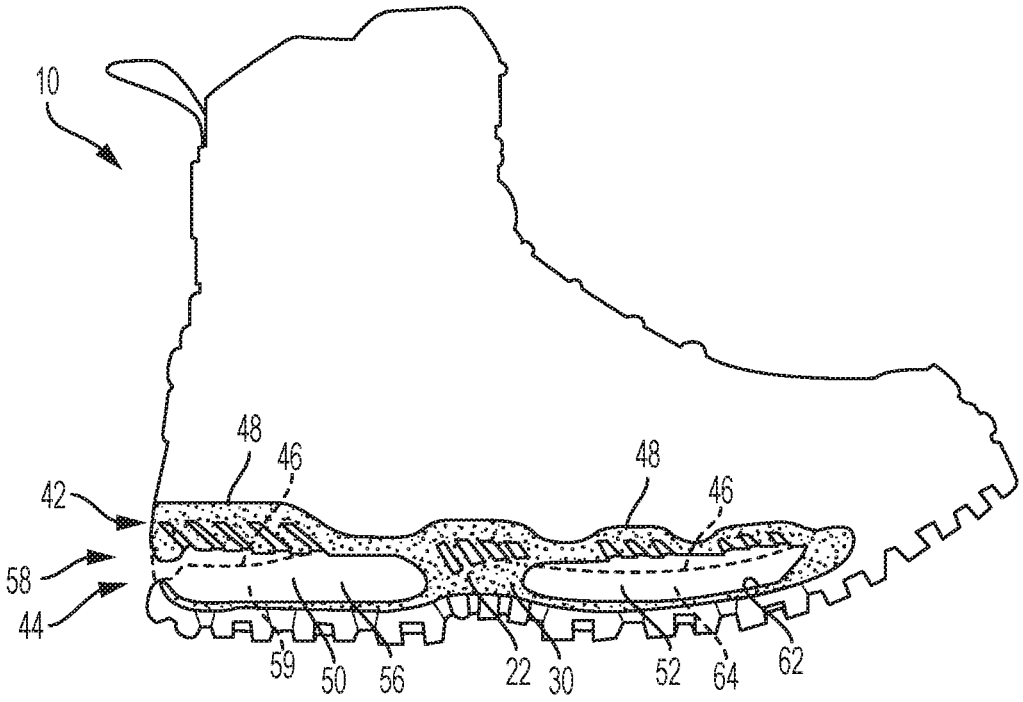
FIG. 3 is a right side view of the midsole of FIG. 2.

FIGS. 1-3 show an example of footwear 10 of the present disclosure. The footwear may include an upper 12 and a sole 14 attached to the upper. Upper 12 may cover any suitable portion of a user's foot. For example, the upper in FIG. 1 has a high cut (or high top) that is designed to extend above a user's ankle bone. Although upper 12 is shown as having a high cut, upper 12 may have a low cut (or low top) that does not extend above a user's ankle bone or may have any suitable cut that covers any suitable portion of a user's foot.

Sole 14 may include any suitable layers, such as an outsole (or outer sole layer) 16, a midsole (or midsole layer) 18, and an interface (or interface layer) 20. Outsole 16, midsole 18, and/or interface 20 may include any suitable material(s), such as thermoplastic polyurethane (TPU), among other materials, e.g., as described below in more detail.

The outsole may extend at least substantially the entire length of the footwear and may include a plurality of projections and/or recesses configured to improve traction. Although the footwear of FIG. 1 includes an outsole that wraps around at least a portion of the toe of the footwear, the footwear of the present disclosure may include any suitable outsole. In some examples, the footwear may include an outsole that does not wrap around the toe and/or may wrap around at least a portion of the heel of the footwear.

Midsole 18 may be disposed between outsole 16 and interface 20 and may include any suitable structure configured to store or absorb kinetic energy and/or return or transfer that energy back into a user's step. For example, midsole 18 may include an energy transfer base 22, as shown in FIGS. 2-3. The energy transfer base may be any suitable shape(s), such as one or more elongate shapes. Additionally, energy transfer base 22 may be made of any suitable materials, such as one or more carbon fibers (or other metal fibers) and/or one or more nylons (such as polyether block amide) overmolded with any suitable compound(s), such as rubber and/or thermoplastic polyurethane compound(s). Energy transfer base 22 may include a top surface 24, a bottom surface 26 (which may be opposed to the top surface), a first side surface 28, a second side surface 30 (which may be opposed to the first side surface), a front surface 32, and a rear surface 34 (which may be opposed to the front surface), as shown in FIGS. 2-3.

Midsole 18 may include at least one cavity 36, which also may be referred to as at least one hollow 36 or at least one void 36. The cavity(ies) may include one or more openings 38 on any suitable surface(s) of midsole 18. For example, cavity(ies) 36 may include one or more openings 38 on top surface 24, bottom surface 26, first side surface 28, second side surface 30, front surface 32, and/or rear surface 34. When cavity 36 includes two or more openings 38 on different sides and/or the same side, the midsole may include a hollow passage 40 fluidly connecting some or all of the openings.

One or more cavities 36 may define an upper portion 42 and a lower portion 44 of energy transfer base 22. In other words, one or more cavities 36 may divide the energy transfer base between upper portion 42 and lower portion 44. The upper portion may be configured to move away from a nominal position and/or toward the lower portion when a force is applied to the upper portion toward the lower portion has a magnitude above a predetermined value, and to move away from the lower portion and/or return to a nominal or equilibrium position when the force applied to the upper portion toward the lower portion has a magnitude at or below a predetermined value, or is no longer applied to the upper portion. The upper portion may move into the space of the cavity(ies) when force is applied to the upper portion toward the lower portion.

For example, upper portion 42 is shown to be moved toward lower portion 44 in dashed lines at 46 in FIG. 3, and the upper portion is shown to be in nominal position or equilibrium position at 48 in FIG. 3. The dashed lines at 46 are only for illustration purposes and may not represent the actual movement of the upper portion toward the lower portion. For example, upper portion 42 may be configured to move toward lower portion in less or more of a degree (or distance) as compared to what is illustrated in FIG. 3.

The predetermined value of the applied force may be any suitable value, such as one, two, or three times the weight of a user (or expected user). The cavities may allow the energy transfer base to be lightweight and/or transfer energy back to a user when the user is walking, running, jumping, and/or other activities. The presence of cavity(ies) may allow the use of one or more materials for the energy transfer base that are not generally associated with energy transfer, such as one or more nylons as described above The midsole may include any suitable number of cavities 36, such as one, two, three, four, five, six, seven or more cavities 36. For example, cavities 36 may include a first cavity 50 and a second cavity 52, as shown in FIGS. 2-3. First cavity 50 may include a first opening 54 on first side surface 28, a second opening 56 on second side surface 30, a third opening 58 on rear surface 34, and a first hollow passage 59 fluidly connecting the first, second, and third openings. Second cavity 52 may include a fourth opening 60 on first side surface 28, a fifth opening 62 on second side surface 30, and a second hollow passage 64 fluidly connecting the fourth and fifth openings.

When the midsole includes two or more cavities, the cavities may be fluidly connected or not fluidly connected. In other words, the cavities may be distinct and separate, and/or may be fluidly connected via one or more passages (not shown). For example, first cavity 50 and second cavity 52 as shown in FIGS. 2-3 are not fluidly connected.

The cavity(ies) may be in any suitable portion(s) of the energy transfer base. For example, the cavity(ies) may be at one or both end portions of the energy transfer base, such as adjacent the front and/or rear surfaces, and/or may be disposed between those surfaces (or along one or more sections between those surfaces). When cavity 36 is at the rear and/or front surface of the energy transfer base, the cavity may have an open end (or open loop end), such as shown at 58 in FIG. 2. The open end may be configured to transfer energy back into a user's step. Additionally, the open end may increase the amount of movement in the energy transfer base providing more energy transfer. A cavity in the energy transfer base that includes an open end may sometimes be referred to as a sole having a "C-shape spring."

Cavity(ies) 36 may have any suitable shape(s). For example, cavity(ies) may have the shape of an elliptic cylinder, as shown in FIG. 2-3. One or more of the hollows may have different shapes, such as circular, triangular, rectangular, and/or any suitable curvilinear and/or rectilinear shape(s).

Additionally, cavity(ies) 36 may be any suitable size(s). For example, one or more cavities 36 may have size(s) that have larger height(s) compared to the height of one or more other cavities. As shown in FIGS. 2-3, the height of first cavity 50 is greater than the height of second cavity 52. The greater height may increase the amount of movement in the energy transfer base providing more energy transfer to a user. Moreover, one or more cavities 36 may have size(s) that provide greater width(s) compared to the width of one or more other hollows. The greater width(s) may increase the amount of movement in the energy transfer base, which may provide more energy transfer to a user. In some examples, the width of a cavity 36 (or the opening of the cavity) may be the same as the width of a surface of the midsole, such as the width of the front surface or the width of the rear surface.

The openings and/or the hollow passages may have any suitable size(s). For example, all of the openings and the hollow passage connecting those openings may be the same height and/or the same width. Alternatively, or additionally, one or more of the openings and/or the hollow passage may have a different height and/or a different width compared to the height and/or width of one or more other openings and/or the hollow passage.

For example, openings 54 and 56 and first hollow passage 59 of first cavity 50 are shown in FIGS. 2-3 to have the same height and the same width. However, the width and/or height of opening 54 may, in other examples, be different from the width and/or height of opening 56, which may be the same or different from the width and/or height of first hollow passage 59. For example, the width and/or height of first hollow passage may be less than or greater than the width and/or height of the first and second openings. When the hollow passage of a cavity 36 has a different width and/or height than the openings, the width and/or height of the hollow passage may increase and/or decrease toward or away from the openings. For example, when the openings are smaller than a center portion of the hollow passage, the size of the hollow passage may increase toward the center portion and decrease toward the openings.

The cavity(ies) of midsole 18 may not include (or exclude) any structure(s) within the cavity(ies). In other words, the openings and hollow passages of the cavity(ies) may be fluidly connected to the ambient environment. Alternatively, or additionally, midsole 18 may include a mesh, foam, and/or other structure (not shown) within and/or around one or more of the cavities configured to prevent debris from entering the cavity(ies). When structure is within cavity(ies) 36, the structure may allow the cavity to be fluidly connected to the ambient environment. For example, mesh within the cavity(ies) may prevent debris from entering the cavity(ies) but allow ambient air to flow through the openings and through the mesh within the cavity(ies).

When midsole 18 is configured to store or absorb kinetic energy and return or transfer that energy back into a user's step, the midsole may sometimes be referred to as a "flex-spring sole." Although midsole 18 is shown to include cavity(ies) 36, the outsole and/or interface may additionally, or alternatively, include the cavity(ies). In some examples, sole 14 may include only a single layer having cavity(ies) 36.

Interface layer 20 may include any structure disposed between the upper and the midsole to provide an interface for the midsole, such as to attach the midsole to the upper. The interface layer may be made of any suitable material(s), such as foam. Although sole 14 is shown to include outsole 16, midsole 18, and interface 20, sole 14 may additionally, or alternatively, include any suitable layer(s). For example, sole 14 may sometimes exclude outsole 16 and/or interface 20. Additionally, although a work boot is shown in FIGS. 1-2, other types of footwear (such as athletic, dress, casual, dance, and orthopedic footwear) may include the structures shown in the above Figures, such as midsole 18.

Examples 2-5

Figure 4:
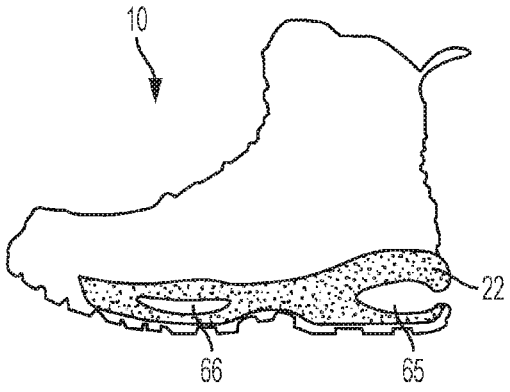
FIGS. 4-7 are left side views of additional examples of a flex-spring sole for the footwear of FIG. 1.

FIGS. 4-7 show embodiments of footwear 10, similar to those described above, but with energy transfer base 22 having different cavities 36. FIG. 4 shows an energy transfer base 22 that is similar to the energy transfer base in Example 1 but with (1) a first cavity 65 having a shorter width and greater height compared to first cavity 50 in Example 1 and (2) a second cavity 66 having a width less than the width of second cavity 52 in Example 1.

Figure 5:
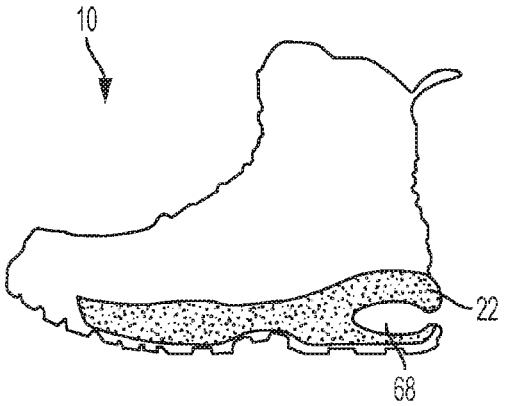
Figure 6:
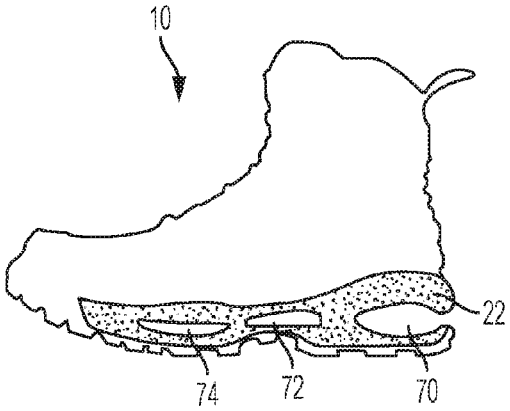
Figure 7:
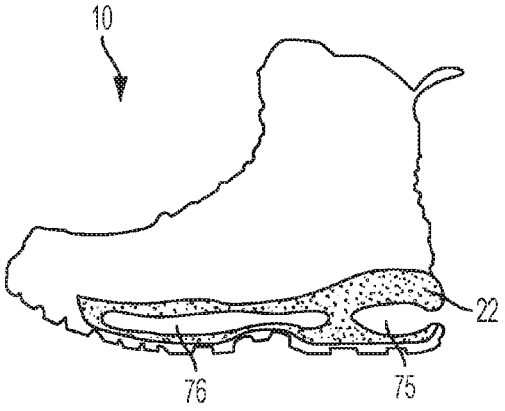

FIG. 5 shows an energy transfer base 22 that includes only a single cavity 68 in the heel portion of the sole similar to first cavity 65 in FIG. 4. FIG. 6 shows an energy transfer base 22 having first, second, and third cavities 70, 72, and 74. FIG. 7 shows an energy transfer base 22 with a first cavity 75 similar to first cavity 65 in FIG. 4, and a second cavity 76 having a width and a height greater than the width and height of second cavity 52 of Example 1.

Other variations of the cavity(ies) in the energy transfer base are included in the present disclosure. In some examples, energy transfer base 22 may extend across the full length of the footwear and include a cavity in the toe portion having an open end, a hollow in the heel portion having an open end, and/or one or more other cavities disposed between the toe and heel portions. Alternatively, energy transfer base 22 may include one or more cavities other than a cavity in the toe portion and/or the heel portion.

Example 6

This section describes additional aspects and features of embodiments presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A0. A sole for footwear, the sole comprising: an energy transfer base having one or more hollows.

A1. The sole of paragraph A0, wherein the energy transfer base includes a heel portion and the one or more hollows includes a first hollow in the heel portion.

A2. The sole of paragraph A1, wherein the first hollow includes an open end.

A3. The sole of paragraph A1, wherein the one or more hollows further includes a second hollow spaced from the first hollow.

A4. The sole of paragraph A1, wherein the one or more hollows includes second and third hollows spaced from the first hollow.

A5. The sole of paragraph A0, wherein the energy transfer base includes one or more carbon fibers overmolded with rubber compounds.

A6. The sole of paragraph A0, wherein the energy transfer base includes one or more carbon fibers overmolded with thermoplastic polyurethane.

A7. The sole of paragraph A0, wherein the energy transfer base includes one or more nylons overmolded with rubber compounds.

A8. The sole of paragraph A0, wherein the energy transfer base includes one or more nylons overmolded with thermoplastic polyurethane.

B0. Footwear comprising: an upper for receiving a foot of a user; and a sole including a midsole, an interface, and an outsole, the interface being coupled to a footwear upper, the midsole being coupled to the interface, the outsole being disposed opposite the upper relative to the midsole, the outsole being configured to transfer kinetic energy between the foot of the user and an external surface via the midsole, the midsole including an energy transfer base having one or more hollows.

B1. The footwear of paragraph B0, wherein the one or more hollows includes at least one hollow having an open end.

B2. The footwear of paragraph B1, wherein the energy transfer base includes a heel portion and the at least one hollow is in the heel portion.

CONCLUSION

The disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A sole for footwear, comprising an energy transfer base, the energy transfer base includes a top surface, a bottom surface, and opposed first and second side surfaces, the energy transfer base further includes at least one cavity, the at least one cavity includes an opening on the first side surface, an opening on the second side surface, and a hollow passage fluidly connecting the openings on the first and second side surfaces, the at least one cavity defines upper and lower portions of the energy transfer base, wherein the upper portion is configured to move away from a nominal position and toward the lower portion when a force applied to the upper portion toward the lower portion has a magnitude that is above a predetermined value, and to move back to the nominal position when at least one of (1) the force is no longer applied or (2) the magnitude of the applied force is at or below the predetermined value, wherein the energy transfer base further includes a rear surface, the at least one cavity further includes an opening that spans the length of the rear surface such that the opening on the first side surface, the opening on the second side surface, and the opening on the rear surface collectively forms a continuous opening between the first side surface and the second side surface, and the hollow passage fluidly connects the openings of the first side surface, the second side surface, and the rear surface, wherein the continuous opening extends from the rear surface to at least 25% of the length of both the first and second side surfaces.

2. The sole of claim 1, wherein the sole excludes structure within the at least one cavity.

3. The sole of claim 1, wherein the at least one cavity includes a first cavity and a second cavity, and the first and second cavities are not fluidly connected, wherein the first cavity includes (1) a first opening on the first side surface, (2) a second opening on the second side surface, and (3) a first hollow passage fluidly connecting the first and second openings, and wherein the second cavity includes (a) a third opening on the first side surface, (b) a fourth opening on the second side surface, and (c) a second hollow passage fluidly connecting the third and fourth openings.

4. The sole of claim 3, wherein energy transfer base includes a rear surface, the first cavity further includes a fifth opening, and the first hollow passage fluidly connects the first, second, and fifth openings.

5. The sole of claim 3, wherein the at least one cavity further includes a third cavity having a sixth opening on the first side surface, a seventh opening on the second side surface, and a third hollow passage fluidly connecting the sixth and seventh openings.

6. The sole of claim 1, wherein (a) the opening on the first side surface, (b) the opening on the second side surface, (c) and the hollow passage have the same width and the same height.

7. The sole of claim 1, wherein the energy transfer base includes carbon fiber overmolded with at least one of (1) one or more rubber compounds or (2) one or more thermoplastic polyurethane compounds.

8. The sole of claim 1, wherein the energy transfer base includes polyether block amide overmolded with at least one of (1) one or more rubber compounds or (2) one or more thermoplastic polyurethane compounds.

9. Footwear, comprising:

an upper for receiving a foot of a user; and a sole including an energy transfer base, the energy transfer base includes a top surface, a bottom surface, and opposed first and second side surfaces, the energy transfer base further includes at least one cavity, the at least one cavity includes an opening on the first side surface, an opening on the second side surface, and a hollow passage fluidly connecting the openings on the first and second side surfaces, the at least one cavity divides the energy transfer base into upper and lower portions, wherein the upper portion is configured to move away from an equilibrium position and toward the lower portion when a force applied to the upper portion toward the lower portion has a magnitude that is above a predetermined value, and to move back to the equilibrium position when at least one of (1) the force is no longer applied or (2) the magnitude of the applied force is at or below the predetermined value, wherein the energy transfer base includes a rear surface, the at least one cavity further includes an opening that spans the length of the rear surface such that the opening on the first side surface, the opening on the second side surface, and the opening on the rear surface collectively forms a continuous opening between the first side surface and the second side surface, and the hollow passage fluidly connects the openings of the first side surface, the second side surface, and the rear surface, wherein the continuous opening extends from the rear surface to at least 25% of the length of both the first and second side surfaces.

10. The footwear of claim 9, wherein the footwear does not include structure within the at least one cavity.

11. The footwear of claim 9, wherein the at least one cavity includes a first cavity and a second cavity, and the first and second cavities are not fluidly connected, wherein the first cavity includes (1) a first opening on the first side surface, (2) a second opening on the second side surface, and (3) a first hollow passage fluidly connecting the first and second openings, and wherein the second cavity includes (a) a third opening on the first side surface, (b) a fourth opening on the second side surface, and (c) a second hollow passage fluidly connecting the third and fourth openings.

12. The footwear of claim 11, wherein energy transfer base includes a rear surface, the first cavity further includes a fifth opening, and the first hollow passage fluidly connects the first, second, and fifth openings.

13. The footwear of claim 11, wherein the at least one cavity further includes a third cavity having a sixth opening on the first side surface, a seventh opening on the second side surface, and a third hollow passage fluidly connecting the sixth and seventh openings.

14. The footwear of claim 9, wherein (a) the opening on the first side surface, (b) the opening on the second side surface, (c) and the hollow passage have the same width and the same height.

15. The footwear of claim 9, wherein the energy transfer base includes carbon fiber overmolded with at least one of (1) one or more rubber compounds or (2) one or more thermoplastic polyurethane compounds.

16. The footwear of claim 9, wherein the energy transfer base includes polyether block amide overmolded with at least one of (1) one or more rubber compounds or (2) one or more thermoplastic polyurethane compounds.

* * * * *